United States Patent [19]

Wang

[11] Patent Number: 4,559,020

[45] Date of Patent: Dec. 17, 1985

[54] INFLATABLE TOY WITH MOVABLE MECHANISM

[76] Inventor: Cheng-Chung Wang, 7th Floor, No. 37, An-Ho Rd., Taipei, Taiwan

[21] Appl. No.: 494,318

[22] Filed: May 13, 1983

[51] Int. Cl.[4] ..... A63H 27/00

[52] U.S. Cl. ..... 446/232; 446/225; 446/241

[58] Field of Search ..... 446/220–226, 446/232, 241, 259, 260, 186, 187, 197, 201; 92/31, 33, 36, 92

[56] References Cited

U.S. PATENT DOCUMENTS

| | | | |
|---|---|---|---|
| 2,937,473 | 5/1960 | Vlachos | 446/197 |
| 3,071,892 | 1/1963 | Clark | 446/226 |
| 3,576,374 | 4/1971 | Lile | 446/186 |
| 4,193,337 | 3/1980 | Disdier | 92/31 |
| 4,291,487 | 9/1981 | Magid | 446/186 |
| 4,391,062 | 7/1983 | Magid | 446/220 |

*Primary Examiner*—Robert A. Hafer
*Assistant Examiner*—Daniel Nolan
*Attorney, Agent, or Firm*—Cushman, Darby and Cushman

[57] ABSTRACT

An inflatable toy comprises at least one external rotary assembly mounted outside the inflatable envelope and at least one internal movable object mounted inside the inflatable envelope. The external rotary assembly and the internal movable object are interconnected by a flexible hollow member which is heat-weldedly attached to the wall of the toy and has a closed end to which the external assembly and internal object are affixed. The internal object can be operated by an external means and the movement of the internal object is transmitted to the external rotary assembly. The rotary assembly is comprised of a rotatable part which is supported by an external supporting means attached to the wall of the envelope, and a rocking part attached to the closed end of the flexible hollow member.

1 Claim, 6 Drawing Figures

INFLATABLE TOY WITH MOVABLE MECHANISM

BACKGROUND OF THE INVENTION

This invention relates to an inflatable toy, particularly to an inflatable toy which has an external rotary assembly to control an internal movable assembly, or an internal movable assembly to control an external rotary assembly.

Inflatable toys with externally controlled internal movable objects have been known in the prior arts. U.S. Pat. No. 4,291,487 discloses inflatable toys having internal movable objects controlled and operated by an external means, such as cord, or rod, which makes linear motion. Although internal objects can operate with either linear or rotary motion inside the inflatable body, there are not provided any external means that can be operated by the internal objects.

SUMMARY OF THE INVENTION

It is an object of the invention to provide an inflatable toy which has internal movable objects such as, oscillator to operate an external rotary assembly.

Another object of the invention is to provide an inflatable toy which has an external rotary assembly driven by an natural force, such as, wind, to operate internal movable objects.

Further object of the invention is to provide an inflatable toy which has an external rotary assembly and internal movable objects that can be operated by an external means.

According to the invention, an inflatable toy includes an envelope made of a gas impervious flexible material which is resilient in part, means for inflating the envelope, and a flexible hollow member having an open end sealingly connected to the wall of the envelope and inwardly projected from the wall, the projection end thereof being closed. An internal movable unit having at least one element which makes linear movement is provided inside the envelope and the linearly movable element is connected to the closed end of the hollow member. There is further provided an external rotary assembly having a rotating part held by an external supporting means and having a rocking part connected to the closed end of the hollow member. The external supporting means is heat weldedly connected to the wall of the envelope and projected outwardly. The internal movable unit can be operated by an external means, such as by vibrating the wall of the envelope with hand, and the movement of the internal movable unit can be transmitted to the external rotary assembly for rotary movement.

Advantageously, the internal movable unit includes a mass suspended from the closed end of the flexible hollow member.

In an aspect of the invention, the inflatable article can include a further rotary assembly mounted outside the wall of the envelope. This further rotary assembly may also include a rotating part supported by a further external supporting means and a rocking part connected to a further flexible hollow member which has a closed projecting end. The two external rotary assemblies are interconnected by the internal movable object and the movement of one of the external rotary assemblies caused by an external means can be transmitted to another rotary assembly through the internal movable unit.

In another aspect of the invention, the inflatable article can include an internal movable unit, an external rotary assembly and an external manually operated means to actuate the internal movable unit. In this case, the internal movable unit can be operated through the external manually operated means and the movement thereof can be transmitted to the external rotary assembly.

Advantageously, the external supporting member can be a rigid hollow in communication with the flexible hollow member. The external rotary assembly may include, a rotatable shaft having a coarse endless helical thread provided thereon and held by the rigid hollow member in a position in which it is allowed to rotate but prevented to move axially, and an axially movable sleeve member connected to the closed end of the flexible hollow member and having an engaging means to be engaged with the thread.

Alternatively, the external supporting member can be a bracket outwardly projected from the wall of the envelope. The external rotary assembly may include, a wheel rotatably mounted on the bracket, and a rocking arm connected to the closed end of the flexible hollow member and to the wheel at a point radially offset from the center of the wheel.

The internal movable unit can be a device that can store an energy, upon being acted by the manually operated means, to operate the external rotary assembly.

The manner in which the above and related objects are accomplished together with the attending advantages and features of the invention will appear more fully from the following detailed description and drawings.

DETAILED DESCRIPTION OF THE PREFERRED EMBODIMENTS

Figure 2:
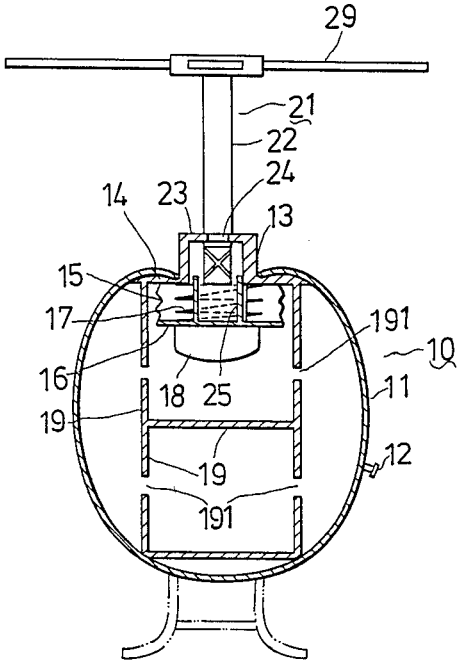
FIG. 2 is a schematic view of a first embodiment.

In FIGS. 1 through 6, there are shown four embodiments of the invention in which elements that are in the same construction and perform in the same manner are designated by the same reference numerals.

As shown in FIG. 2, a first embodiment of the invention includes an inflatable toy 10 which has an envelope 11 shaped to conform to a helicopter and made of a gas impervious flexible material which is resilient in part. A valve 12 is provided on the wall of the toy for inflating purposes. There is further provided an opening at which a rigid support member 13 which is in the form of a hollow cylinder is heat-weldedly attached to the flexible wall of the envelope 11 with its flange 14. A flexible hollow member 15 is heat sealed to the flange 14 with its open end and is inwardly projected from the inner wall of the envelope. The projecting end 16 of the flexible hollow member 15 is closed. A spring 17 is affixed to the flange 14 and the closed end 16. From the closed end 16 is further suspended a mass 18 of certain weight. This can be accomplished by heat sealing a plastic body which is weighed by a metal mass or the like.

There is further provided an inner supporting means which can be a plastic plate 19 heat-weldedly attached to the inner sides of the walls of the toy 10. It can be provided with perforations 191 so that the plate 19 will allow communication everywhere in the envelope.

Figure 4:
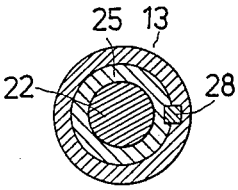
FIG. 4 is a fragmentary sectioned view taken from the line IV—IV of FIG. 3.
Figure 3:
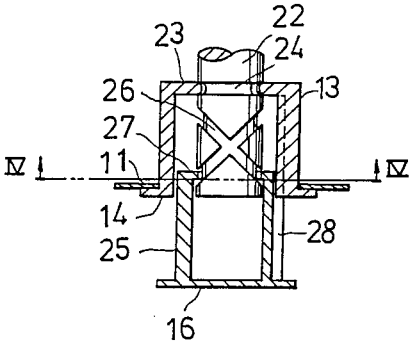
FIG. 3 is an enlarged view of the portion taken from FIG. 2.

An external rotary assembly 21 outside the wall of the toy 10 is comprised of a rotatable shaft 22 which is mounted in the rigid hollow supporting member 13 in a manner that the shaft 22 is allowed to rotate but prevented to move axially as better seen in FIGS. 3 and 4. This is accomplished by providing an annular projection 23 at the end of the rigid supporting member to engage with an annular recess 24 provided in the periphery of the shaft 22, and providing an axially movable sleeve member 25 which is heat welded to the closed end 16. A coarse, endless helical thread 26 is further provided on the shaft 22 below the annular recess 24 for engaging with a projection 27 of the sleeve member 25. Between the sleeve member 25 and the supporting member 13 is provided a guide key 28 which is fixed to the sleeve member 25 and is slidably received in a recess provided in the wall of the supporting member 13. At the end of the shaft 22 is provided a propeller 29.

In the operation, the wall of the toy 10 is caused to vibrate such as by squeezing or the like manner, and accordingly the mass 18 will oscillate. The oscillating movement of the mass 18 is transmitted to the closed end 16 of the flexible hollow member 15 and then to the sleeve member 25 for up and down movement. As the sleeve member 25 is moved, the projection 27 that can only make axial movement will cause the helical thread 26 to move so that the shaft 22 will rotate.

Figure 5:
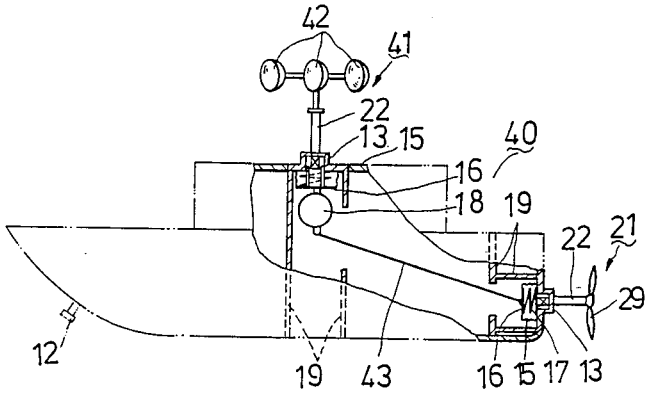
FIG. 5 is a schematic view of a second embodiment of the invention.

Now referring to FIG. 5, the second embodiment of the invention includes an inflatable toy 40 which is shaped to conform to a ship and is made of a gas impervious flexible material which is resilient in part. A valve 12 is provided on the wall of the toy 40 for inflating purpose. Two openings are provided respectively at a top portion and a rear portion of the toy ship 40, and at these openings are respectively provided two flexible hollow members 15, two springs 17, and two rigid support members 13. From the closed end 16 of one of the flexible hollow members 15 is suspended a mass 18 of certain weight.

Plates 19 are attached to the inner side of the wall of the toy 40 as an internal supporting means. An external rotary assembly 21 is mounted on one of the support members 13 and is in the same construction as the external rotary assembly of the first embodiment. The propeller 29 of the rotary assembly 21 provided at the rear portion of the toy ship 40 will act as a drive means for the toy. The propeller 29 is operated, through a connector 43 which can be a string, by another external rotary assembly 41 which is substantially in the same construction as the rotary assembly 21, except having a meteorological object which includes wind actuated cups 42, instead of the propeller 29.

Figure 1:
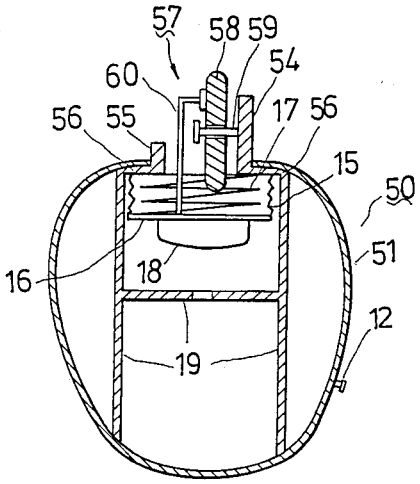
FIG. 1 is a schematic view of a third embodiment.

Now referring to FIG. 1, there is shown a third embodiment which includes an inflatable toy 50 which has an envelope 51 made of a gas impervious, flexible and resilient material. The envelope has an opening at which is provided a flexible hollow member 15, a spring member 17 and an inflating means 12. An external supporting means which may be comprised of two brackets 54 and 55 each of which has a flange 56 heat welded to the wall of the envelope 51. At the closed end 16 of the flexible hollow member 15 is attached a mass 18 which can be motive when an external force acts on the envelope to make the wall thereof vibrate.

An external rotary assembly 57 is mounted to the external supporting means. It includes, a wheel 58 rotatable on a horizontal shaft 59 which is supported by the bracket 54 and a rocking arm 60 which is attached to the wheel 58 at a point radially offset from the center thereof and connected to the closed end 16 of the flexible hollow member 15. When the mass 18 is motive, the movement of the closed end 16 of the flexible hollow member 15 is transmitted to the rocking arm 60 and then the rotatable wheel 58.

Figure 6:
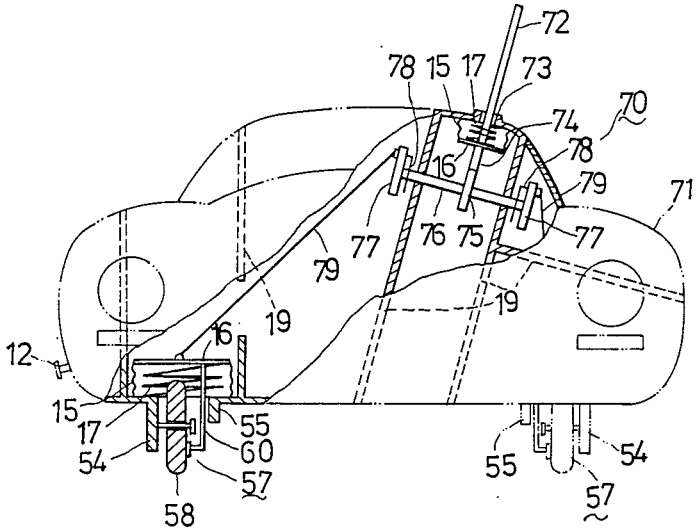
FIG. 6 is a schematic view of a fourth embodiment of the invention.

Referring to FIG. 6, there is shown a fourth embodiment which is an inflatable toy 70 having an envelope 71 shaped to conform to a car toy and made of a gas impervious flexible material which is resilient in part. The toy 70 has four external rotary assemblies 57 which behave like wheels of the car (only two front wheels are shown in FIG. 6). Each of the rotary assemblies 57 is mounted outside the envelope 71 by means of the supporting means having two brackets 54 and 55 and the flexible hollow member 15, and can be operated by an external manually operated means through an internal movable unit. The external manually operated means is formed into a radio telescopic tube 72 which can be operated by hand to move the closed end 16 of a flexible hollow member 15 provided at the top of the toy 70. The telescopic tube 72 is attached to the closed end 16 and is supported by a supporting member 73 which is in the form of a sleeve and heat welded to the envelope 71.

To the inner side of the closed end 16 is attached a rack 74 having inclined teeth (not shown) thereon and engaged with a ratchet 75 which makes one direction rotary movement when the rack 74 move downward and is mounted on a shaft 76 which is journalled in the inner supporting plates 19. At the two ends of the shaft 76 are attached two rotatable discs 77 and to each of the discs 77 is affixed a flat sprial spring 78 with its one end. The other end of the spring 78 is fixed to the shaft 76 so that it can be wound about the shaft 76 when the ratchet 75 rotates in a single direction. This spring 78 stores an energy which will be then given to the disc 77 to rotate when it reverses to its original position.

The rotation of a disc 77 will be transmitted to the closed end of the flexible hollow member 15 to which a wheel is attached, through a connecting means which can be a rigid rod 79 having one end connected to the closed end 16 and another end connected to the disc 77 at a point radially offset from the center of the disc 77. The movement of the closed end 16 of the flexible hollow member 15 will cause the wheel 58 to move via rocking arm 60. It is to be noted that, when the rack 74 and the ratchet 75 are operated, the disc 77 must be immobilized such as by catching the wheel 58 with hand so that the rotation of the shaft 76 can make the spring wind on the shaft 76.

With the invention thus explained, it is apparent that obvious modifications and variations can be made without departing from the scope of the invention. It is therefore intended that the invention be limited only as indicated in the appended claims.

What I claim is:

1. An inflatable article comprising:

an envelope having a wall made of a gas impervious flexible material which has a resilient portion and which has an opening in a portion of said wall;

means for inflating said envelope;

a flexible hollow member having an open end sealingly connected to said wall and communicated with said opening, said hollow member having a closed end projecting into said envelope from said wall;

a spring member disposed in said hollow member for providing a resiliency;

a rigid hollow external support member, in communication with said flexible hollow member, projected from and connected to said wall at an adjacent position thereon relative to said flexible hollow member;

an internal supporting member inside said envelope and attached to said wall;

a linearly movable element provided inside said envelope and connected to said closed end of said hollow member; and an external rotary assembly having a rotating part held by said external supporting member, the rotary assembly including a rotatable shaft having an endless helical thread provided thereon and an axially movable sleeve member and an engaging member engaged with said thread.

* * * * *